US011129459B2

(12) United States Patent
Abdul

(10) Patent No.: US 11,129,459 B2
(45) Date of Patent: Sep. 28, 2021

(54) PORTABLE HAIR DRYING ASSEMBLY

(71) Applicant: Lisa Abdul, Garfield, NJ (US)

(72) Inventor: Lisa Abdul, Garfield, NJ (US)

( * ) Notice: Subject to any disclaimer, the term of this patent is extended or adjusted under 35 U.S.C. 154(b) by 84 days.

(21) Appl. No.: 16/441,164

(22) Filed: Jun. 14, 2019

(65) Prior Publication Data

US 2020/0390219 A1 Dec. 17, 2020

(51) Int. Cl.
*A45D 20/18* (2006.01)
*A45D 20/34* (2006.01)

(52) U.S. Cl.
CPC ..... *A45D 20/34* (2013.01)

(58) Field of Classification Search
CPC ..... A45D 20/14; A45D 20/24; A45D 20/22; A45D 20/18; A45D 20/34; A45D 20/08; A45D 20/26; A45D 20/28; A45D 20/30
USPC ..... 34/9, 97, 96, 283
See application file for complete search history.

(56) References Cited

U.S. PATENT DOCUMENTS

| | | | | |
|---|---|---|---|---|
| 3,391,470 | A * | 7/1968 | Conkling | A45D 20/22 34/99 |
| 3,946,498 | A * | 3/1976 | Waters | A45D 20/18 34/99 |
| 5,038,783 | A | 8/1991 | Dumoulin | |
| 5,313,716 | A | 5/1994 | Wolfe | |
| 5,651,190 | A | 7/1997 | Sanders | |
| 5,787,601 | A | 8/1998 | Stelly | |
| 6,964,116 | B2 * | 11/2005 | Kroll | A45D 20/00 2/174 |
| 7,946,056 | B2 * | 5/2011 | Kroll | A45D 20/42 34/96 |
| 9,131,760 | B1 * | 9/2015 | Townsend | A45D 20/34 |

* cited by examiner

*Primary Examiner* — John P McCormack

(57) ABSTRACT

A portable hair drying assembly for drying a user's hair includes a bowl that is wearable on a user's head thereby facilitating the bowl to be in thermal communication with hair on the user's head. The bowl has an air chamber that is positioned within the bowl and a plurality of air apertures that is each in fluid communication with the air chamber. A housing is removably coupled to the bowl and the housing has an intake and an exhaust. The exhaust is in fluid communication with the air chamber when the housing is removably coupled to the bowl. A blower is positioned within the housing to blow air onto the user's hair when the bowl is worn on the user's head. A heating unit is positioned within the housing to heat the air being blown by the blower thereby enhancing drying the user's hair.

11 Claims, 4 Drawing Sheets

PORTABLE HAIR DRYING ASSEMBLY

CROSS-REFERENCE TO RELATED APPLICATIONS

Statement Regarding Federally Sponsored Research or Development

Not Applicable

The Names of the Parties to a Joint Research Agreement

Not Applicable

Incorporation-by-Reference of Material Submitted on a Compact Disc or as a Text File Via the Office Electronic Filing System Not Applicable

Statement Regarding Prior Disclosures by the Inventor or Joint Inventor

Not Applicable

BACKGROUND OF THE INVENTION

(1) Field of the Invention

(2) Description of Related Art Including Information Disclosed Under 37 CFR 1.97 and 1.98

The disclosure and prior art relates to drying devices and more particularly pertains to a new drying device for drying a user's hair.

BRIEF SUMMARY OF THE INVENTION

An embodiment of the disclosure meets the needs presented above by generally comprising a bowl that is wearable on a user's head thereby facilitating the bowl to be in thermal communication with hair on the user's head. The bowl has an air chamber that is positioned within the bowl and a plurality of air apertures that is each in fluid communication with the air chamber. A housing is removably coupled to the bowl and the housing has an intake and an exhaust. The exhaust is in fluid communication with the air chamber when the housing is removably coupled to the bowl. A blower is positioned within the housing to blow air onto the user's hair when the bowl is worn on the user's head. A heating unit is positioned within the housing to heat the air being blown by the blower thereby enhancing drying the user's hair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
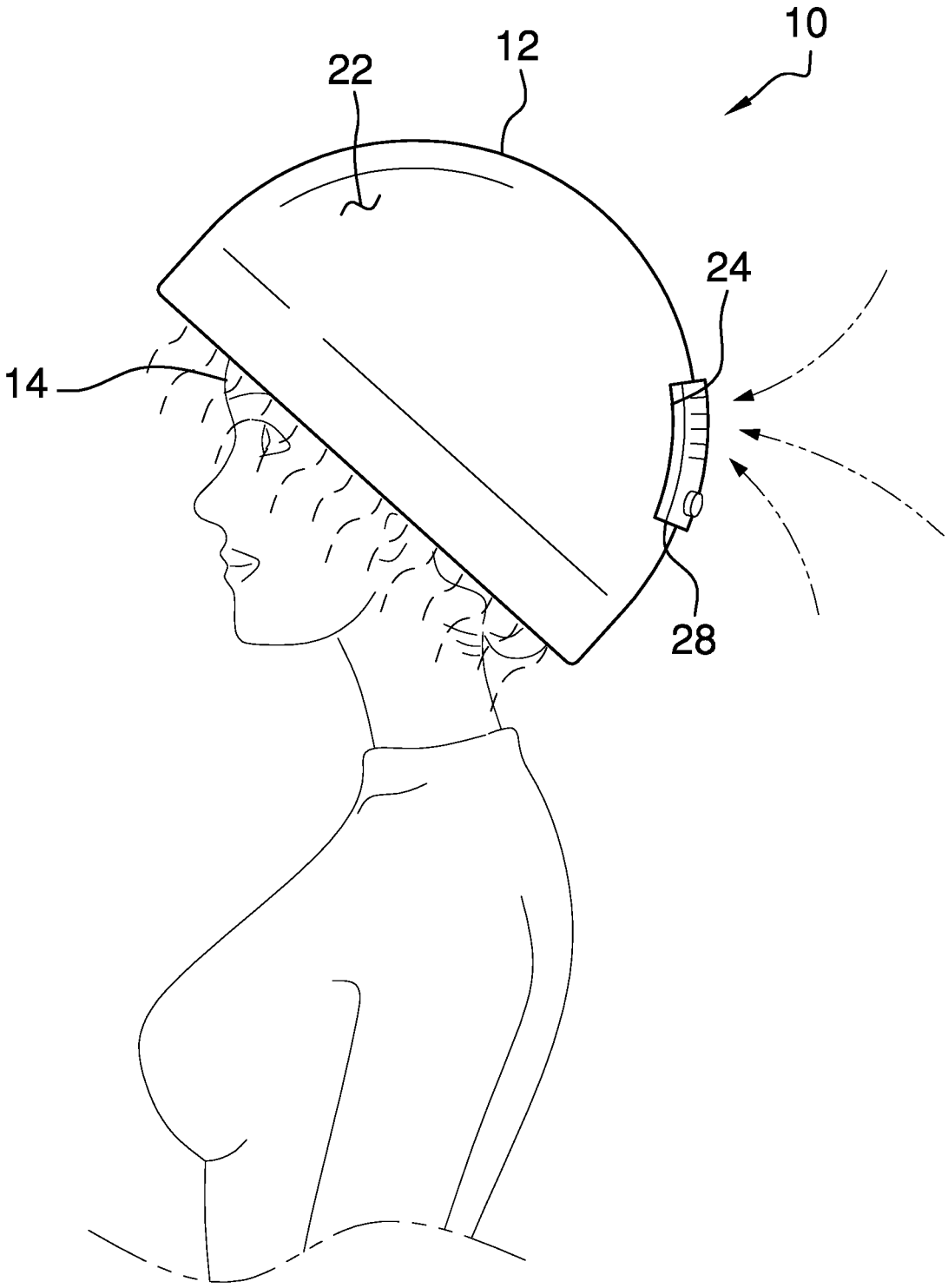
FIG. 1 is a perspective in-use view of a portable hair drying assembly according to an embodiment of the disclosure.
Figure 2:
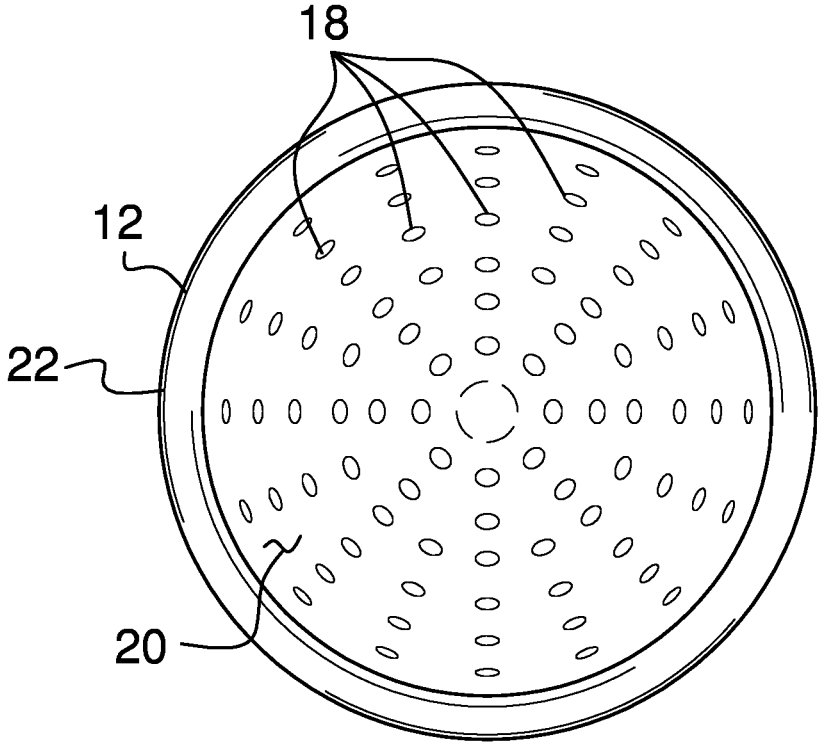
FIG. 2 is a bottom view of an embodiment of the disclosure.
Figure 3:
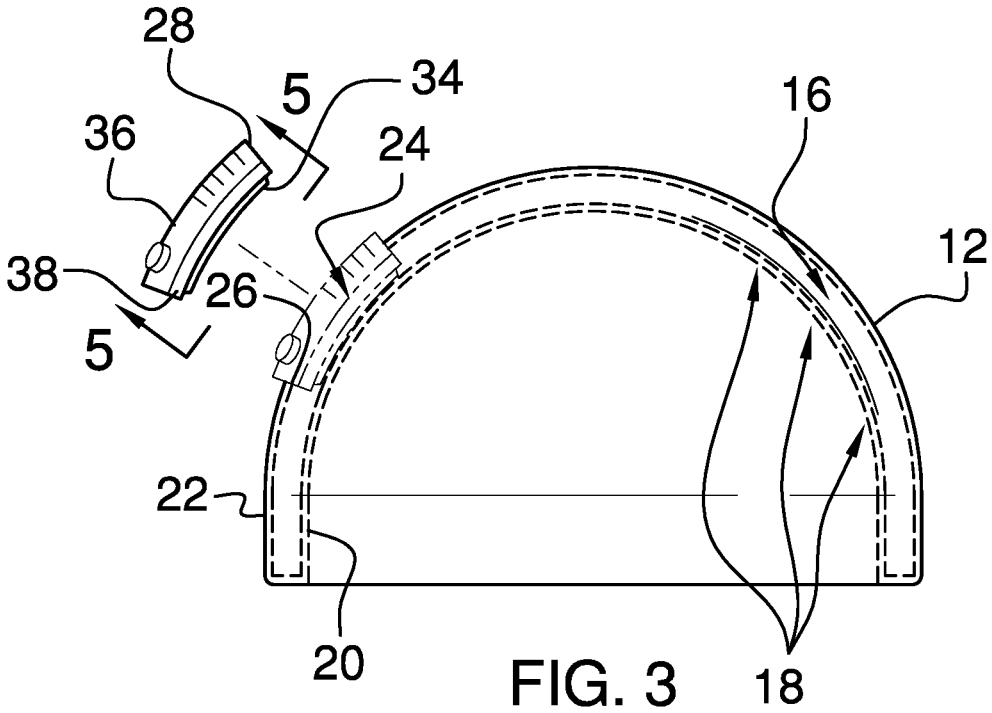
FIG. 3 is a right side phantom view of an embodiment of the disclosure.
Figure 4:
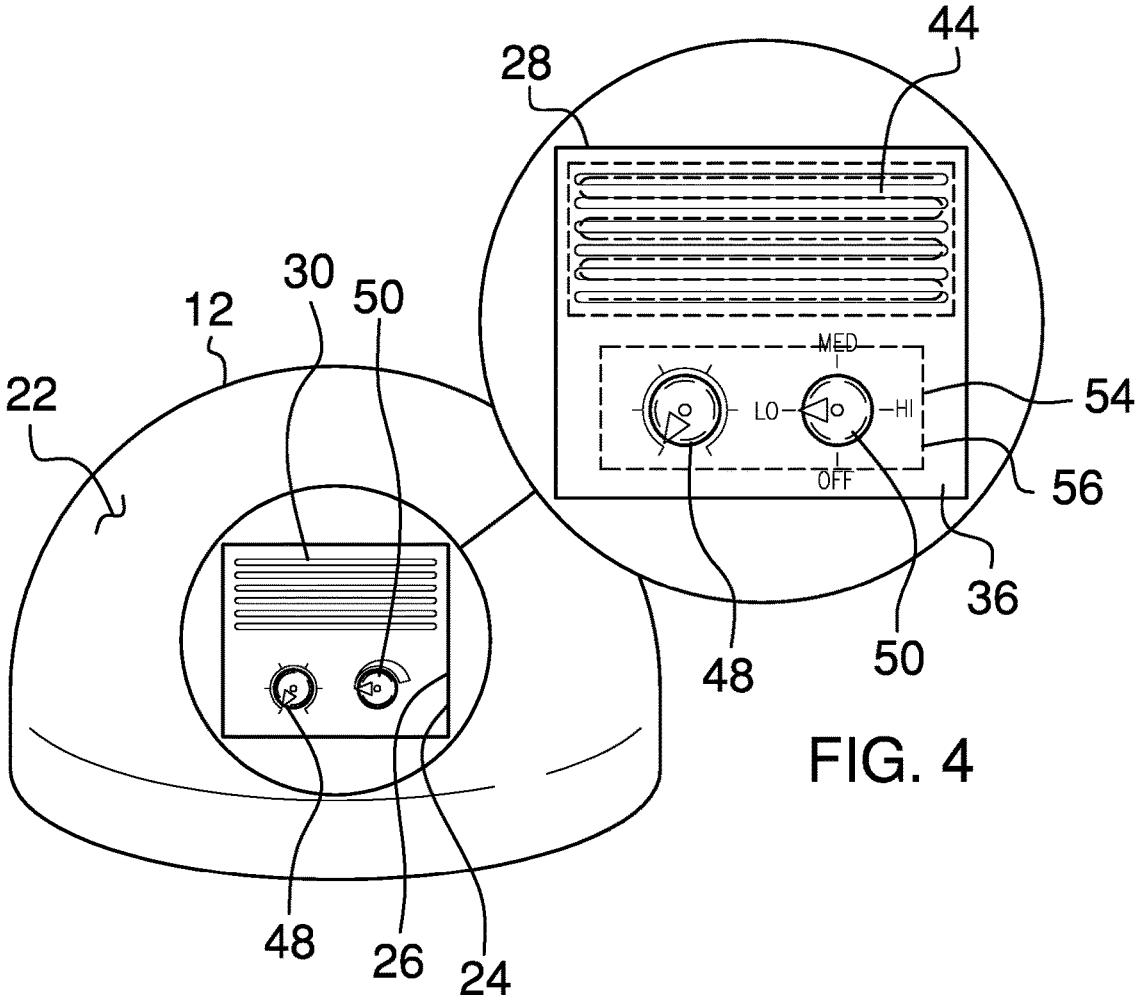
FIG. 4 is a back view of an embodiment of the disclosure.
Figure 5:
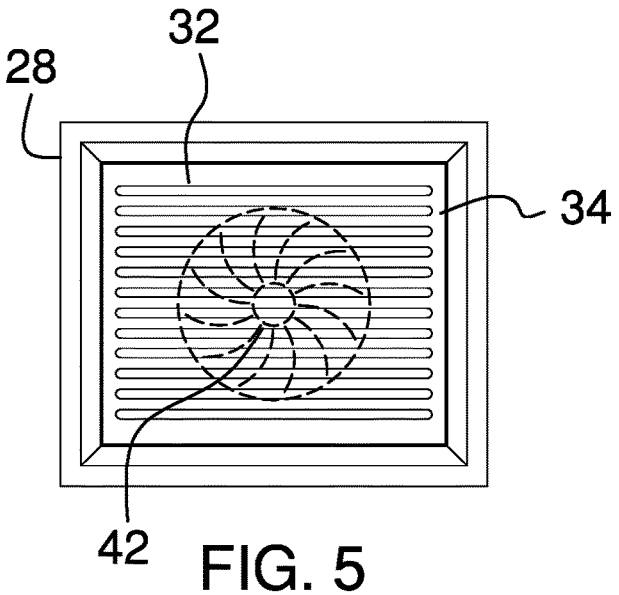
FIG. 5 is a cross sectional view taken along line 5-5 of FIG. 3 of an embodiment of the disclosure.
Figure 6:
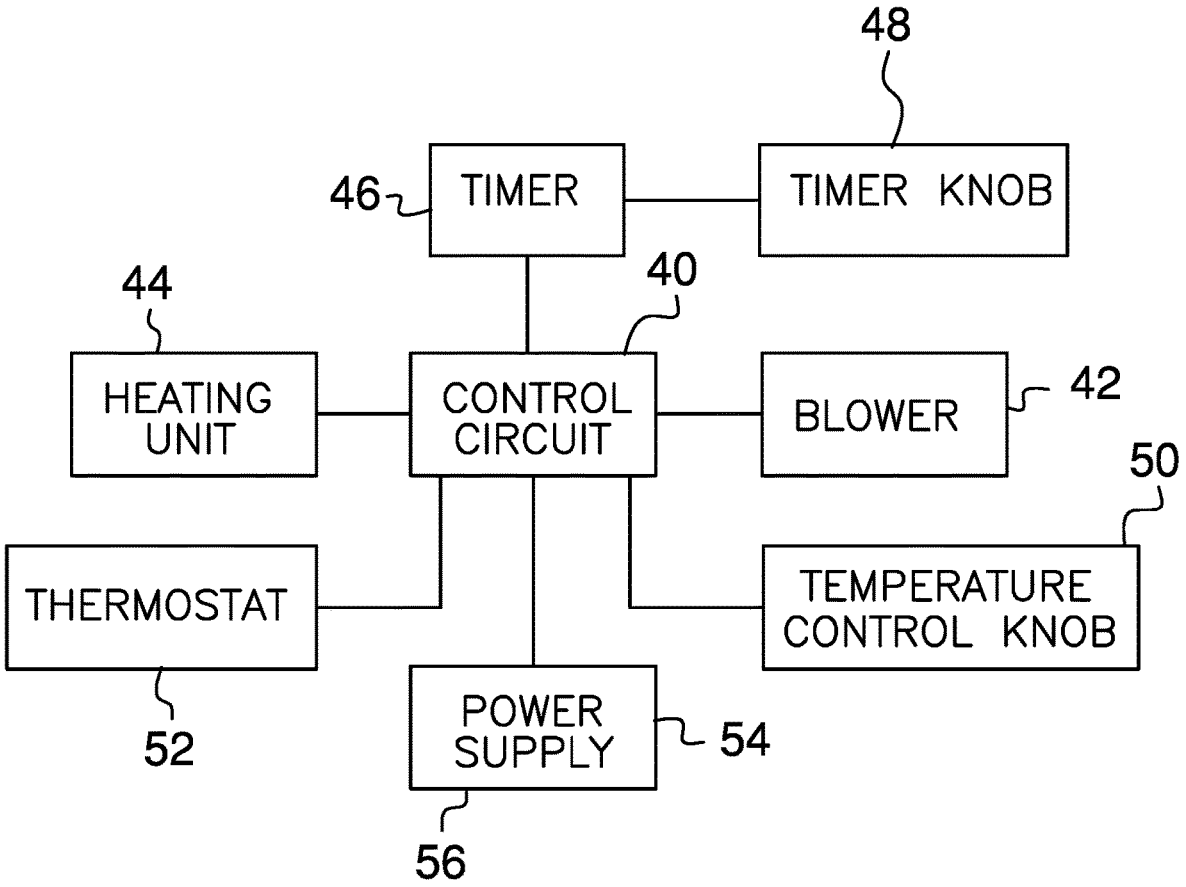
FIG. 6 is a schematic view of an embodiment of the disclosure.

With reference now to the drawings, and in particular to FIGS. 1 through 6 thereof, a new drying device embodying the principles and concepts of an embodiment of the disclosure and generally designated by the reference numeral 10 will be described.

As best illustrated in FIGS. 1 through 6, the portable hair drying assembly 10 generally comprises a bowl 12 that is wearable on a user's head 14 thereby facilitating the bowl 12 to be in thermal communication with hair on the user's head 14. The bowl 12 has an air chamber 16 positioned within the bowl 12 and a plurality of air apertures 18 that are each in fluid communication with the air chamber 16. The bowl 12 has an interior surface 20 and an exterior surface 22, and the air chamber 16 is between positioned between the interior 20 and exterior 22 surfaces. Moreover, each of the plurality of air apertures 18 extends through the interior surface 20 and into the air chamber 16 to pass air outwardly from the air chamber 16. The air apertures 18 are spaced apart from each other and are distributed over an entire circumference of the interior surface 20. The exterior surface 22 has an input opening 24 extending into the air chamber 16 to pass air into the air chamber 16 and the input opening 24 has a bounding edge 26.

A housing 28 is provided and the housing 28 is removably coupled to the bowl 12. The housing 28 has an intake 30 and an exhaust 32, and the exhaust 32 is in fluid communication with the air chamber 16 when the housing 28 is removably coupled to the bowl 12. The housing 28 has a front wall 34, a rear wall 36 and an outer wall 38 extending therebetween. The housing 28 is positioned in the input opening 24 and the outer wall 38 releasably engages the bounding edge 26 of the input opening 24 for retaining the housing 28 in the input opening 24. The intake 30 extends through the rear wall 36 and the exhaust 32 extends through the front wall 34. Moreover, the front wall 34 extends through the input opening 24 when the housing 28 is positioned in the input opening 24 having the rear wall 36 being exposed with respect to the exterior surface 22 of the bowl 12.

A control circuit 40 is positioned within the housing 28. A blower 42 is positioned within the housing 28 to urge air into the air chamber 16 and outwardly through each of the air apertures 18 when the blower 42 is turned on. In this way blower 42 blows air onto the user's hair when the bowl 12 is worn on the user's head 14. The blower 42 urges air inwardly through the intake 30 in the rear wall 36 of the housing 28 and outwardly through the exhaust 32 in the front wall 34 of the housing 28 when the blower 42 is turned on and when the housing 28 is positioned in the input opening 24. The blower 42 is electrically coupled to the control circuit 40, and the blower 42 may include an electric motor and a fan that is rotatably coupled to the electric motor.

A heating unit 44 is provided and the heating unit 44 is positioned within the housing 28 such that the heating unit 44 is in thermal communication with an interior of the housing 28. In this way the heating unit 44 can heat the air that is blown by the blower 42 when the heating unit 44 is turned on thereby enhancing drying the user's hair. The heating unit 44 is electrically coupled to the control circuit 40. The heating unit 44 may comprise an electric heating coil or the like that has an operational temperature ranging between approximately 90.0 degrees Fahrenheit and 140.0 degrees Fahrenheit.

A timer 46 is provided, the timer 46 is coupled to the housing 28 and the timer 46 is electrically coupled to the control circuit 40. The control circuit 40 turns off each of the heating unit 44 and the blower 42 when a pre-determined amount of time has elapsed. Additionally, the timer 46 is adjustable between a minimum duration of time and a maximum duration of time. The timer 46 includes a timer knob 48 that is rotatably coupled to the rear wall 36 of the housing 28 for setting the pre-determined duration of time. The timer 46 may comprise an electronic timer or the like. The minimum duration of time may be approximately 10.0 minutes and the maximum duration of time may be approximately 60.0 minutes.

A temperature control knob 50 is rotatably coupled to the rear wall 36 of the housing 28 and the temperature control knob 50 is electrically coupled to the control circuit 40. The temperature control knob 50 is positionable in an off position, a low position, a medium position or a high position. Each of the blower 42 and the heating unit 44 is turned off when the temperature control knob 50 is positioned in the off position. Additionally, each of the blower 42 and the heating unit 44 is turned on when the temperature control knob 50 is positioned in any of the low, medium or high positions.

The heating unit 44 is actuated to generate a minimum amount of heat when the temperature control knob 50 is positioned in the low position. The heating unit 44 is actuated to generate a medium amount of heat when the temperature control knob 50 is positioned in the medium position. The heating unit 44 is actuated to generate a maximum amount of heat when the temperature control knob 50 is positioned in the high position. The temperature control knob 50 may comprise a rheostat or other type of electronic temperature control.

A thermostat 52 is coupled to the housing 28 such that the thermostat 52 is in thermal communication with an interior of the housing 28. The thermostat 52 is electrically coupled to the control circuit 40. The control circuit 40 turns the heating unit 44 off when the thermostat 52 senses that the temperature within the housing 28 exceeds a pre-determined temperature. In this way the thermostat 52 inhibits the user from is burned. The thermostat 52 may be an electronic thermostat or the like and the pre-determined temperature may be approximately 150.0 degrees Fahrenheit. A power supply 54 is coupled to the housing 28, the power supply 54 is electrically coupled to the control circuit 40 and the power supply 54 comprises at least one battery 56.

In use, the housing 28 is positioned in the input opening 24 in the bowl 12 and each of the temperature control knob 50 and the timer knob 48 are adjusted to preferred settings. Thus, the heating unit 44 is turned on to heat the air within the housing 28 and the blower 42 is turned on the blow air outwardly through each of the air apertures 18 in the bowl 12. The bowl 12 is worn on the user's head 14 when the user's hair is wet from washing or styling. In this way the heated air that is blown outwardly through each of the air apertures 18 in the bowl 12 is directed onto the user's hair for drying the user's hair. Moreover, the user can perform any activities while the bowl 12 is being worn on the user's head 14. In this way the user does not have to remain stationary as would be required when the user is employing a stationary hair dryer.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable hair drying assembly being configured to be worn on a user's head thereby facilitating the user's hair to be dried, said assembly comprising:

a bowl being wearable on the user's head thereby facilitating said bowl to be in thermal communication with hair on the user's head, said bowl having an air chamber being positioned within said bowl and a plurality of air apertures each being in fluid communication with said air chamber, said bowl having an interior surface and an exterior surface, said interior surface being uniformly spaced from said exterior surface wherein said air chamber extends continuously between an entirety of said interior surface and said exterior surface, each of said plurality of air apertures extending through said interior surface and into said air chamber wherein each of said air apertures is configured to pass air outwardly from said air chamber, said air apertures being spaced apart from each other and being distributed over an entire circumference of said interior surface;

a housing being removably coupled to said bowl, said housing having an intake and an exhaust, said exhaust being in fluid communication with said air chamber when said housing is removably coupled to said bowl;

a blower being positioned within said housing wherein said blower is configured to urge air into said air chamber and outwardly through each of said air apertures when said blower is turned on thereby facilitating the air to be blown onto the user's hair when said bowl is worn on the user's head; and a heating unit being positioned within said housing such that said heating unit is in thermal communication with an interior of said housing wherein said heating unit is configured to heat the air being blown by said blower when said heating unit is turned on thereby enhancing drying the user's hair.

2. The assembly according to claim 1, wherein said exterior surface has an input opening extending into said air chamber wherein said input opening is configured to pass air into said air chamber, said input opening having a bounding edge.

3. The assembly according to claim 2, wherein said housing has a front wall, a rear wall and an outer wall extending therebetween, said housing being positioned in said input opening having said outer wall releasably engaging said bounding edge of said input opening for retaining said housing in said input opening, said intake extending through said rear wall, said exhaust extending through said front wall, said front wall extending through said input opening when said housing is positioned in said input opening having said rear wall being exposed with respect to said exterior surface of said bowl.

4. The assembly according to claim 3, further comprising a control circuit being positioned within said housing.

5. The assembly according to claim 4, wherein said blower urges air inwardly through said intake in said rear wall of said housing and outwardly through said exhaust in said front wall of said housing when said blower is turned on and when said housing is positioned in said input opening, said blower being electrically coupled to said control circuit.

6. The assembly according to claim 4, further comprising a timer being coupled to said housing, said timer being electrically coupled to said control circuit, said control circuit turning off each of said heating unit and said blower when a pre-determined amount of time has elapsed, said timer being adjustable between a minimum duration of time and a maximum duration of time, said timer including a timer knob being rotatably coupled to said rear wall of said housing wherein said timer knob is configured to be manipulated by the user for setting the pre-determined duration of time.

7. The assembly according to claim 4, further comprising a temperature control knob being rotatably coupled to said rear wall of said housing wherein said temperature control knob is configured to be manipulated by the user, said temperature control knob being electrically coupled to said control circuit, said temperature control knob being positionable in an off position, a low position, a medium position or a high position, each of said blower and said heating unit being turned off when said temperature control knob is positioned in said off position, each of said blower and said heating unit is turned on when said temperature control knob is positioned in any of said low, medium or high positions.

8. The assembly according to claim 7, wherein said heating unit is actuated to generate a minimum amount of heat when said temperature control knob is positioned in said low position, said heating unit being actuated to generate a medium amount of heat when said temperature control knob is positioned in said medium position, said heating unit being actuated to generate a maximum amount of heat when said temperature control knob is positioned in said high position.

9. The assembly according to claim 4, further comprising a thermostat being coupled to said housing such that said thermostat is in thermal communication with an interior of said housing, said thermostat being electrically coupled to said control circuit, said control circuit turning said heating unit off when said thermostat senses that the temperature within said housing exceeds a pre-determined temperature wherein said thermostat is configured to inhibit the user from being burned.

10. The assembly according to claim 4, further comprising a power supply being coupled to said housing, said power supply being electrically coupled to said control circuit, said power supply comprising at least one battery.

11. A portable hair drying assembly being configured to be worn on a user's head thereby facilitating the user's hair to be dried, said assembly comprising:

a bowl being wearable on the user's head thereby facilitating said bowl to be in thermal communication with hair on the user's head, said bowl having an air chamber being positioned within said bowl and a plurality of air apertures each being in fluid communication with said air chamber, said bowl having an interior surface and an exterior surface, said interior surface being uniformly spaced from said exterior surface wherein said air chamber extends continuously between an entirety of said interior surface and said exterior surface, each of said plurality of air apertures extending through said interior surface and into said air chamber wherein each of said air apertures is configured to pass air outwardly from said air chamber, said air apertures being spaced apart from each other and being distributed over an entire circumference of said interior surface, said exterior surface having an input opening extending into said air chamber wherein said input opening is configured to pass air into said air chamber, said input opening having a bounding edge;

a housing being removably coupled to said bowl, said housing having an intake and an exhaust, said exhaust being in fluid communication with said air chamber when said housing is removably coupled to said bowl, said housing having a front wall, a rear wall and an outer wall extending therebetween, said housing being positioned in said input opening having said outer wall releasably engaging said bounding edge of said input opening for retaining said housing in said input opening, said intake extending through said rear wall, said exhaust extending through said front wall, said front wall extending through said input opening when said housing is positioned in said input opening having said rear wall being exposed with respect to said exterior surface of said bowl;

a control circuit being positioned within said housing;

a blower being positioned within said housing wherein said blower is configured to urge air into said air chamber and outwardly through each of said air apertures when said blower is turned on thereby facilitating the air to be blown onto the user's hair when said bowl is worn on the user's head, said blower urging air inwardly through said intake in said rear wall of said housing and outwardly through said exhaust in said front wall of said housing when said blower is turned on and when said housing is positioned in said input opening, said blower being electrically coupled to said control circuit;

a heating unit being positioned within said housing such that said heating unit is in thermal communication with an interior of said housing wherein said heating unit is configured to heat the air being blown by said blower when said heating unit is turned on thereby enhancing drying the user's hair, said heating unit being electrically coupled to said control circuit;

a timer being coupled to said housing, said timer being electrically coupled to said control circuit, said control circuit turning off each of said heating unit and said blower when a pre-determined amount of time has elapsed, said timer being adjustable between a minimum duration of time and a maximum duration of time, said timer including a timer knob being rotatably coupled to said rear wall of said housing wherein said timer knob is configured to be manipulated by the user for setting the pre-determined duration of time;

a temperature control knob being rotatably coupled to said rear wall of said housing wherein said temperature control knob is configured to be manipulated by the user, said temperature control knob being electrically coupled to said control circuit, said temperature control knob being positionable in an off position, a low position, a medium position or a high position, each of said blower and said heating unit being turned off when said temperature control knob is positioned in said off position, each of said blower and said heating unit being turned on when said temperature control knob is positioned in any of said low, medium or high positions, said heating unit being actuated to generate a minimum amount of heat when said temperature control knob is positioned in said low position, said heating unit being actuated to generate a medium amount of heat when said temperature control knob is positioned in said medium position, said heating unit being actuated to generate a maximum amount of heat when said temperature control knob is positioned in said high position;

a thermostat being coupled to said housing such that said thermostat is in thermal communication with an interior of said housing, said thermostat being electrically coupled to said control circuit, said control circuit turning said heating unit off when said thermostat senses that the temperature within said housing exceeds a pre-determined temperature wherein said thermostat is configured to inhibit the user from being burned; and a power supply being coupled to said housing, said power supply being electrically coupled to said control circuit, said power supply comprising at least one battery.

* * * * *